United States Patent [19]

Anderson

[11] Patent Number: 4,812,702

[45] Date of Patent: Mar. 14, 1989

[54] EXCITATION COIL FOR HID ELECTRODELESS DISCHARGE LAMP

[75] Inventor: M. John Anderson, Scotia, N.Y.

[73] Assignee: General Electric Company, Schenectady, N.Y.

[21] Appl. No.: 138,005

[22] Filed: Dec. 28, 1987

[51] Int. Cl.[4] ..... H01J 1/50

[52] U.S. Cl. ..... 313/153; 315/344

[58] Field of Search ..... 313/153, 160, 161, 162; 315/338, 344, 347, 248

[56] References Cited

U.S. PATENT DOCUMENTS 3,763,392 10/1973 Hollister ..... 315/248

FOREIGN PATENT DOCUMENTS 15840 5/1973 Japan ..... 313/161

*Primary Examiner*—David K. Moore
*Assistant Examiner*—K. Wieder
*Attorney, Agent, or Firm*—Geoffrey H. Krauss; James C. Davis, Jr.; Marvin Snyder

[57] ABSTRACT

An excitation coil, for stimulating a high-intensity-discharge plasma in an electrodeless discharge lamp, has at least one turn of a conductor arranged generally upon the surface of a toroid with a rhomboid or V-shaped cross-section, which is substantially symmetrical about a plane passing through the maxima of the toroid. The major radius of the coil is such that the lamp is insertable into the coil so that the coil induces a co-planar toroid plasma discharge arc in the lamp, when the coil is connected to a radio frequency (RF) power source.

20 Claims, 4 Drawing Sheets

24a
L
24
24b
10'
26
10'a
28
10'b
CT

10'
22a
22b
12
11
14
11c
11b
11a
22
A
B
C
24-1'
24'a
24'p
24'
24-2'
24-3'
24-4'
24-5'
24-6'
24-7'
24'c
24'b
24
24-1
24-2
24-3
24-4
24-5
24-6
24-7
24-8
24a
24'p
26
28
24'b
24b
10'a
10'b
24

EXCITATION COIL FOR HID ELECTRODELESS DISCHARGE LAMP

BACKGROUND OF THE INVENTION

The present invention relates to a radio-frequency (RF) coil for exciting a plasma discharge, and, more specifically, to a novel RF coil for exciting a visible-light-producing plasma in a high-intensity discharge (HID) electrodeless lamp and having a shape with reduced blockage of the luminous flux from the discharge lamp.

It is now well known that visible light can be produced from a discharge plasma excited by RF current. The RF current is provided by a coil, generally exterior to the lamp in which the discharge is excited, which coil must not only have satisfactory coupling to the discharge plasma, but must also have low RF resistive loss and small physical size to allow the majority of the light, released from the discharge, to be utilized and not be blocked by the coil itself. The usual excitation coil is of a long solenoidal shape, being derived from the single solenoidal coils of copper tubing, regularly utilized with water cooling, for exciting plasma torches utilized in crystal growing, fiberoptics manufacture and the like.

Prior art, as exemplified by U.S. Pat. Nos. 3,860,854 (cup-shaped coil); 3,763,392 (short solenoid); 3,942,058 and 3,943,404 (small high-intensity discharge lamps at the end of coaxial cable), all have low optical efficacy and has coil losses which can be reduced.

BRIEF SUMMARY OF THE INVENTION

In accordance with the invention, an excitation coil for stimulating a high-intensity-discharge plasma in an electrodeless discharge lamp, comprises: at least one turn of a conductor arranged generally upon the surface of a torus having a substantially rhomboid or V-shaped cross-section on either side of a coil center line. The coil may be substantially symmetrical about a plane passing through the maxima of the toroid. The major radius of the coil is such that the lamp is insertable into the coil so that the coil induces a co-planar toroid plasma discharge arc in the lamp, when the coil is connected to a radio frequency (RF) power source.

In a presently preferred embodiment, tapped reactance (capacitance or inductance) impedance matching is used between the coil and the power source. A balanced split coil can be used. Preferably, as much of the excitation coil as possible should appear to be at twice the arc torus major radius, for high coupling.

Accordingly, it is an object of the present invention to provide a novel excitation coil for stimulating a high-intensity arc discharge plasma in an electrodeless discharge lamp.

This and other objects of the present invention will become apparent upon reading of the following detailed description, when considered in conjunction with the drawings.

DETAILED DESCRIPTION OF THE INVENTION

Figure 1B:
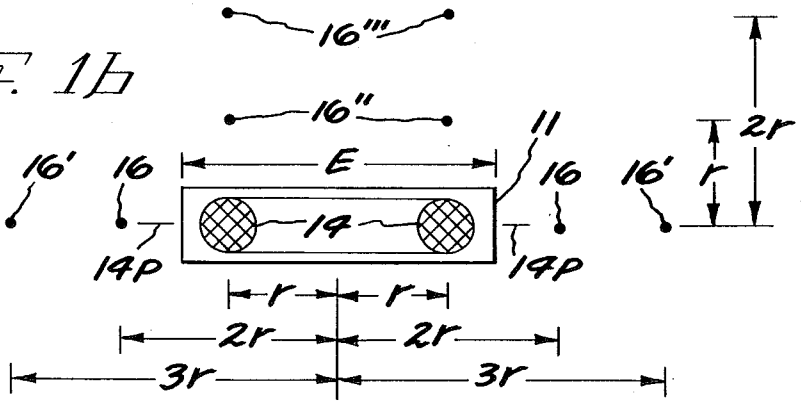
FIG. 1*b* is a sectional view of the lamp/coil combination of FIG. 1*a*, and showing additional excitation coil locations.
Figure 1C:
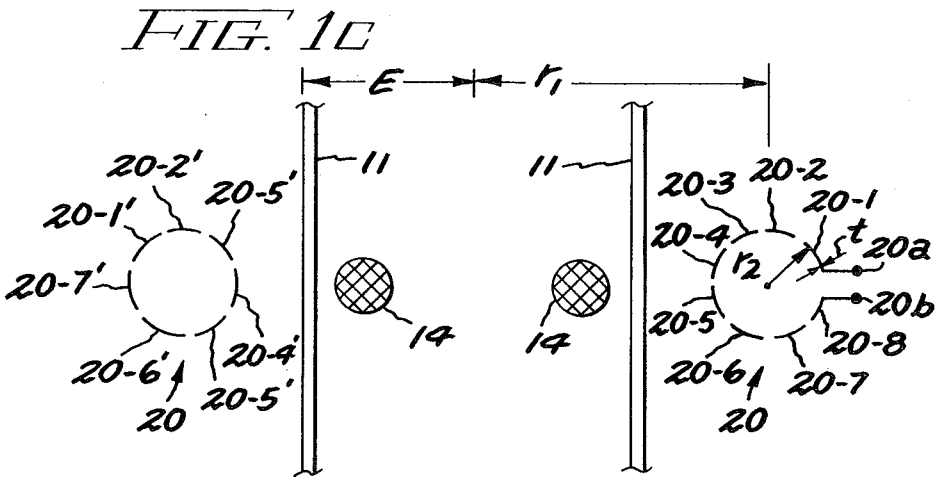
FIG. 1*c* is a side view of a portion of a HID lamp, illustrating one possible multi-turn excitation coil configuration.
Figure 1A:
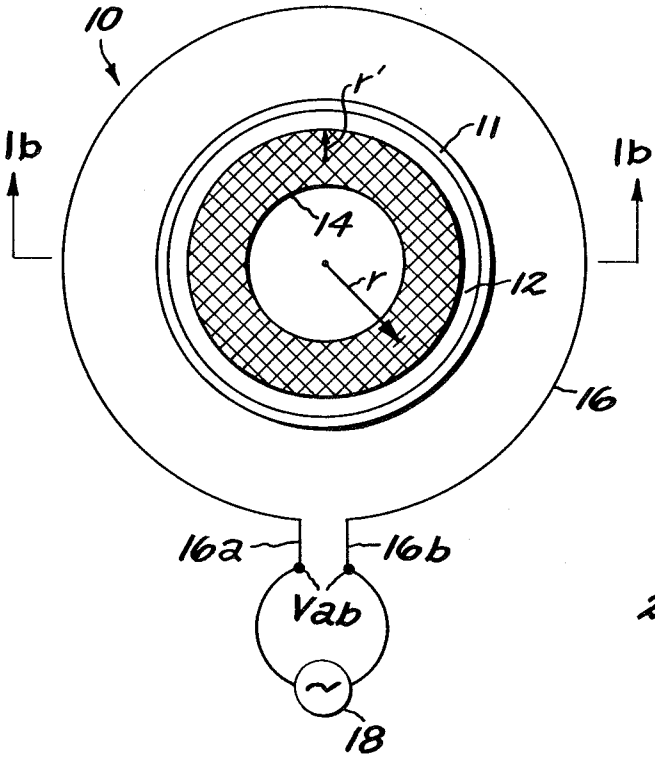
FIG. 1*a* is a plan view of a HID lamp and of a single turn excitation coil, useful in appreciation of several principles of the present invention.

Referring initially to FIG. 1*a* a high-intensity discharge (HID) lamp 10 comprises a tube envelope 11 enclosing a volume 12 containing a quantity of at least one gas in which a discharge arc plasma 14 is producible responsive to the flow of a radio-frequency (RF) current in an excitation coil 16 positioned about the exterior of lamp envelope 11. The RF current flow is responsive to an excitation source 18 providing a voltage $V_{ab}$ between coil ends 16*a* and 16*b*. Typically, discharge arc plasma 14 is in the shape of a toroidal ring, or doughnut, with a minor radius r', setting the thickness of the plasma, and a major radius r, setting the size of the ring. Excitation coil 16 is a single-turn planar ring with a plane parallel to the plane of the arc torus major radius r.

Referring now to FIG. 1*b*, I have found that the best location for a single-turn coil 16 to be situated in, for coupling to a small-diameter conducting discharge plasma ring 14, is with both the coil loop 16 and the plasma loop 14 in the same plane. Thus, excitation coil 16 lies in the plane 14*p* cutting through the plasma ring cross-section (itself shown by the cross-hatched area). For a torus having an average radius r, a coupling coefficient of about 0.36 occurs between that torus and a one-turn excitation coil 16 having a radius equal to twice the plasma toroid radius, i.e. a coil radius of 2r, and in plane 14*p*. I have also found that another one-turn excitation coil 16', lying in the toroid plane and having a radius equal to 3r, will have a coupling coefficient of about 0.173; a single-turn excitation coil 16'' having the same radius r as the discharge plasma and having its plane parallel to, but at a separation distance r above, the plasma toroid plane 14*p* will have a coupling coefficient of about 0.264, while another single-turn excitation coil 16''' having the same diameter and co-planar positioning, but with a separation distance 2r from the toroidal plane 14*p*, has a coupling coefficient of about 0.056. It is therefore highly advantageous to place all of the excitation coil at the highest coupling position, i.e. in the toroidal plane and with average radius 2r. Typically, the excitation coil has a number N of turns greater than one, so that the multi-turn coil must still be positioned about the optimum plane, and with the coil having an absolute minimum diameter greater than the outer wall dimension E of the discharge tube envelope 11. It will be seen that minimum blockage of the light-producing lamp tube 11 occurs if the multiple turns of excitation coil 16 have the smallest possible extent in the direction perpendicular to the discharge plasma toroid plane 14*p* (here, minimized dimensions in the vertical plane, for a horizontally-disposed torus 14). The resistive properties of the coil must simultaneously be minimized, for minimum loss, while the inductive properties of the excitation coil must simultaneously be such that proper tuning and impedance matching of the excitation coil and its generator 18 can be carried out at the associated RF frequency, e.g. at one of the standard ISM frequencies (such as 13.56 MHz).

One possible coil configuration tending to meet these criteria is that of coil 20, in FIG. 1*c*. Here, coil 20 has a multiple number of conductive strips placed upon the exterior surface of an imaginary torus having a major radius $r_1$ of dimension about 2r, and a minor radius $r_2$ of dimension less than the difference between radius $r_1$ and the sum of the lamp tube exterior radius (E/2) and the thickness t of the coil turn members. It will be seen that not only is this multiple-turn coil (illustrated in this cross-sectional view, for N=8) particularly difficult to fabricate, but also it is such that the substantial voltage drop, which must be sustained between the opposite coil ends 20*a* and 20*b* (and which may typically is on the order of $V_{ab}$ of about 1000 volts), requires substantial separation between adjacent ones of turns portions 20-1 through 20-8; this separation is not easily providable, especially if both the thickness t of the elements is at least sufficient such that each turn (reduced to a round wire) is large enough to reduce the skin-depth RF losses, and a sufficiently small subtended angle, at the discharge is provided to minimize light blockage. It will also be seen that there must be sufficient spacing between the discharge plasma 14 and coil 20 to support a reasonable temperature gradient from the approximately 5000° K. temperature of arc plasma 14 to ambient room temperature (about 300° K.) near coil 20, and still allow the arc-containing envelope 11 to be at a reasonable temperature. Even with a ribbon-formed coil 20, with ribbons of thickness t of about 0.02 mm., such a coil is not practical for low cost production.

Figures 2, 2A:
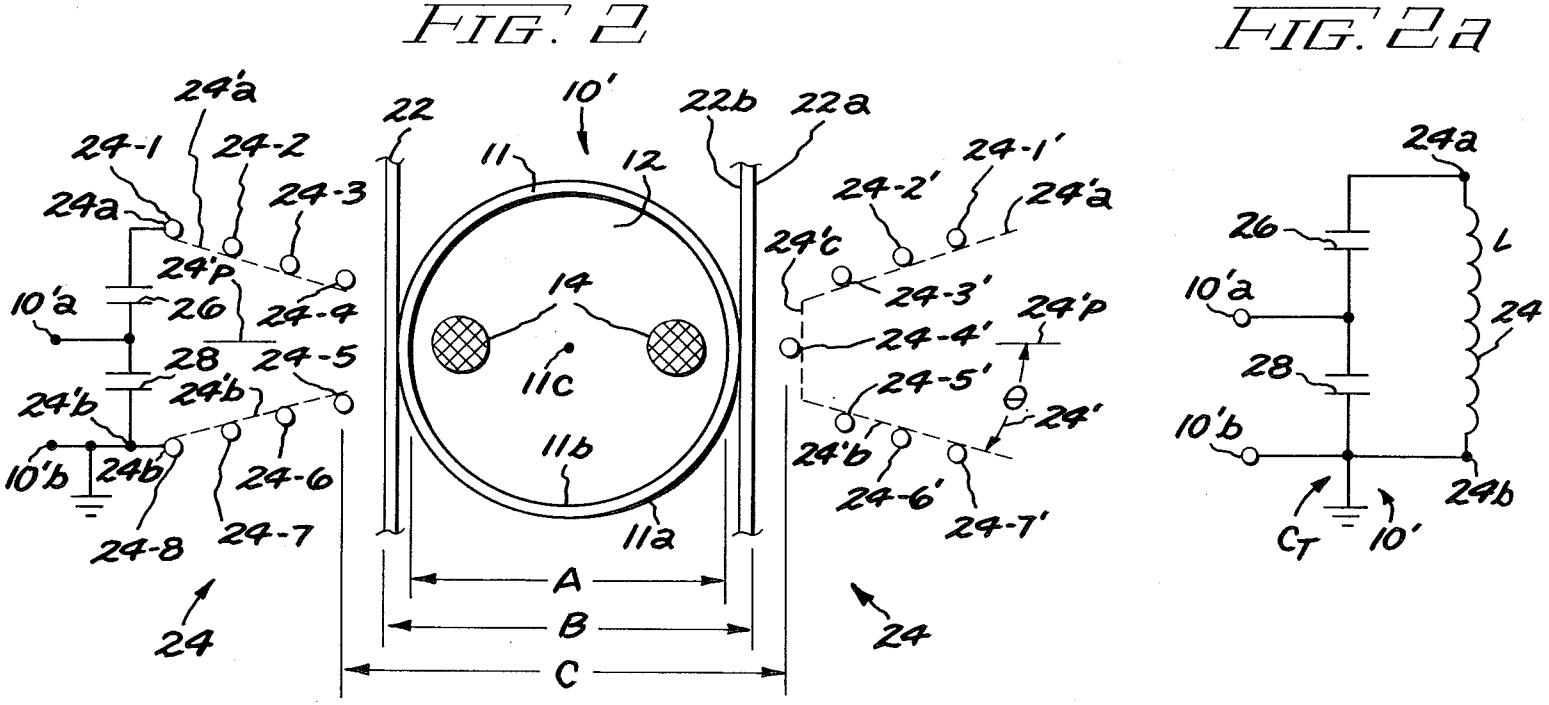
FIG. 2 is a side view of a portion of a HID lamp and one presently preferred embodiment of an excitation coil in accordance with the principles of the present invention.
FIG. 2*a* is a schematic diagram of the circuit formed by the excitation coil and auxiliary elements of FIG. 2.

Referring now to FIG. 2, I presently prefer a lamp 10' in which the light-producing discharge plasma 14 is excited adjacent to the interior surface 11*b* of an envelope 11, having the interior surface 22*b* of a cylindrical positioning envelope 22 attached to the arc-containing envelope exterior surface 11*a*. In accordance with one presently preferred embodiment of this invention, the excitation coil 24 is arranged about the outer envelope exterior surface 22*a* as a plurality N (here N=8) of turns arranged upon the sloped sides 24'*a* and 24'*b*, of an imaginary forming mandrel 24', of circular shape in the same plane 24'*p* as the plane of the discharge plasma torus 14, and having a substantially rhomboid cross-section with each of slanted surfaces 24'*a* 20 and 24'*b* at an angle $\theta$ (less than about 80° and greater than about 10°) with respect to the centerline plane 24'*p*. Advantageously, one may consider the coil turn conductors 24-1 through 24-8 and 24-1' through 24-7' to be on the surface of a torus with a V-shaped cross-section, where the apex of angle $\theta$ may be at the center 11*c* of the arc-containing envelope. The inner edge 24'*c* of the mandrel is spaced at a distance slightly greater than the distance C between innermost turns, here 24-4, 24-5 and mid-turn location 24-4'. This dimension C is greater than both the dimension A of the arc-containing envelope interior surface 11*b* and the dimension B of the exterior surface 22*a* of the outer envelope 22. Thus, one end 24*a* of the coil starts at the radially-furthest location on upper slanted surface 24'*a*, reaches one-half turn at radially-opposed position 24-1', and completes a full turn at position 24-2. A one-and-one-half turn position 24-2' is followed by a two-full turn position 24-3, a two-and-one-half turn position 24-3' and a three-full turn position 24-4. The coil midpoint, along interior "nose" surface 24'*c*, occurs at position 24-4'. The fifth-full turn occurs at position 24-5, with the respective 5½, 6, 6½, 7, 7½ and 8 turn positions being at respective positions 24-5', 24-6, 24-6', 24-7, 24-7' and 24-8.

Referring now to FIG. 2*a*, the inductance L of coil 24, between coil ends 24*a* and 24*b*, can be tuned to resonance with a total tuning capacitance $C_T$ comprised of first and second series-connected capacitances 26 and 28. The ratio of capacitance 26 and capacitance 28 is adjusted, simultaneous with resonance adjustments, such that the driving impedance between terminals 10'*a* and 10'*b* will match the driving impedance of the generator supplying power to the excitation coil, in manner known to the art.

Figure 3A:
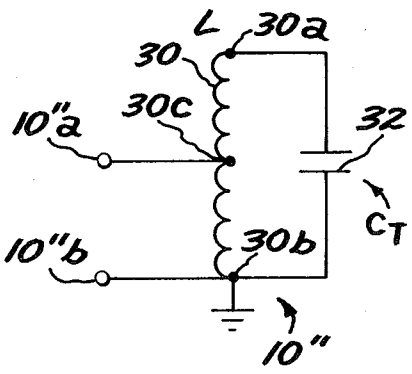
FIG. 3*a* is a schematic diagram of the electrical circuit of the excitation coil, and auxiliary elements of FIG. 3.
Figure 3:
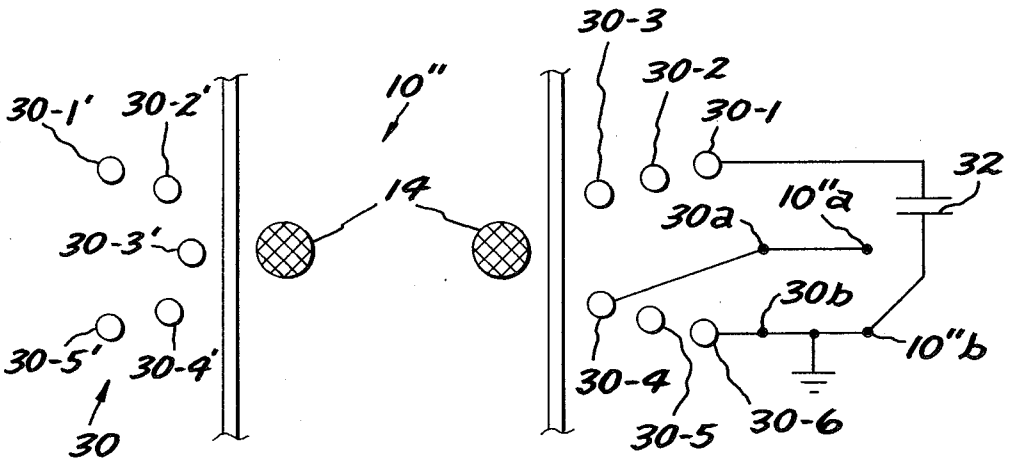
FIG. 3 is a side view of a portion of another HID lamp and another presently preferred embodiment of the excitation coil of present invention.

Referring now to FIG. 3 and 3*a*, in another presently preferred lamp embodiment 10'', the multi-turn V-cross-section excitation coil 30 has a single resonating capacitor 32, of value $C_T$, connected between the coil ends 30*a* and 30*b*, with the coil being tapped at a point 30*c* for impedance matching to the generator (not shown). In both embodiments 24 and 30, there is considerable spacing between turns, even if the coil is fabricated of a fairly large diameter tubing, e.g. of one-eighth inch copper tubing (having a large interior diameter for facilitating a flow of a heat-dissipating fluid). The opposed coil ends 24*a*/24*b* or 30*a*/30*b* are suitably separated for standing off hundreds of volts of RF potential. The rounded wire/tubing surface is presented to the magnetic flux which exists only on the outside of the coil; the size of the wire or tubing can be varied to change this area. In addition, the coil is folded away from the discharge to reduce light blockage, while as many turns as possible are located near to the discharge plane, to maximize the RF-to-plasma coupling. At the same time, the maximum potential across the coil is at points furthest away from the discharge, to minimize E-mode discharge and emphasize H-mode excitation. It will be seen that it is fairly easy to fabricate a winding form which can be used to build such a coil with spacing between adjacent turns being substantially equal at all turn positions. I have found that coupling for a N=8 turn coil of one-eighth inch copper tubing can be on the order of 0.2, for coupling to a lamp with an arc-confining envelope with a diameter on the order of 0.8 inches.

Figure 4B:
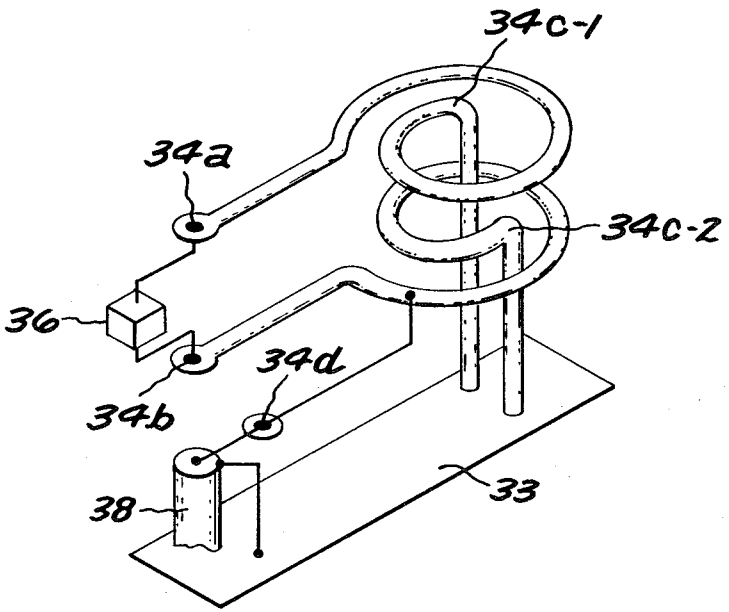
FIGS. 4, 4*a* and 4*b* are respectively a schematic diagram, a schematic side view, and a plan view of another presently preferred multi-turn excitation coil, in accordance with the principles of the present invention.
Figure 4:
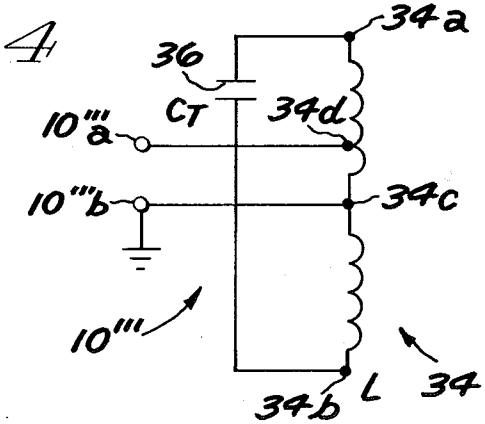
Figure 4A:
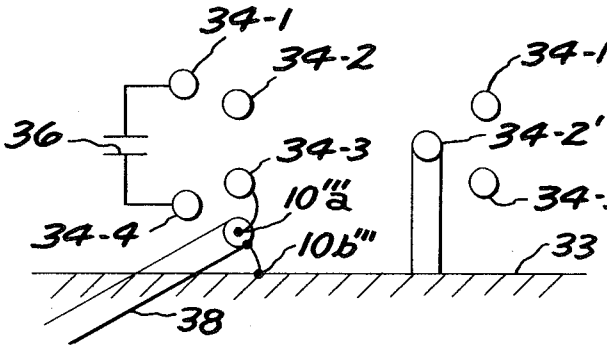

Referring now to all of FIGS. 4, 4*a* and 4*b*, in yet another presently preferred embodiment 10''', an excitation coil 34 has a center tap 34*c* positioned substantially between opposite coil ends 34*a* and 34*b*, so that the center turn is broken and returned to a ground plane 33 with two separate lead portions 34*c*-1 and 34*c*-2. This provides two separate heat-conducting paths to the ground plane heat sink, to remove coil heat and reduce, or eliminate, the need for artificial cooling. The multi-turn, V-cross-section coil 34 is tuned by a single resonance capacitor 36, and is fed at a tap point 34*d*, from a coaxial cable 38 connected to the generator. As best seen in FIG. 4*b*, the three turn coil is broken into a pair of one-and-one-half turn coils, with the upper half portion extending from top coil end 34*a* to first ground lead 34c-1 and the bottom half portion of the total coil extending from the top end of second ground lead 34c-2, past the inductive tap point 34d, to the coil bottom end 34b.

While several presently preferred variations of my novel excitation coil, having as large a percentage as possible of the multiple turns thereof in, or near, the horizontal plane passing through the plasma torus, or upon the surface of an imaginary V-shaped ring concentric thereabout, have been described by way of example herein, many modifications and variations will now be apparent to those skilled in the art. It is my intent, therefore, to be limited only by the scope of the appended claims and not by the specific details and instrumentalities presented by way of explanation of the preferred embodiments described herein.

What I claim is:

1. An excitation coil, for stimulating a high intensity discharge plasma in an electrodeless discharge lamp, comprising:

at least one turn of a conductor arranged generally upon an exterior surface of a torus having a substantially V-shaped cross-section; and means for tuning the inductance of the toroidal conductor to a desired resonance frequency.

2. The coil of claim 1, further comprising means for matching the impedance of the toroidal conductor to a desired impedance.

3. The coil of claim 2, wherein the impedance matching means includes the tuning means.

4. The coil of claim 1, wherein the cross-section of the torus form is substantially symmetrical about a plane passing through the maxima of the conductor torus.

5. The coil of claim 4, wherein the conductor torus includes a plurality N of turns of conductor.

6. The coil of claim 5, wherein N=8.

7. The coil of claim 5, wherein the slanted surfaces of the cross-section of the torus, if extended, appear to merge substantially at the geometric center of the coil.

8. The coil of claim 5, wherein the coil contains a substantially integer number N of turns.

9. The coil of claim 8, wherein the slanted surfaces of the cross-section of the torus, if extended, appear to merge substantially at the geometric center of the coil.

10. The coil of claim 9, wherein the midpoint of the coil conductor is located interior of the angle formed by the slanted surfaces of the coil cross-section.

11. The coil of claim 4, wherein each slanted cross-sectional surface of the coil is at an angle, with respect to said plane, of at least 10° and not more than 80°.

12. The coil of claim 1, wherein the coil contains a plurality of turns.

13. The coil of claim 12, wherein the spacing between turns is substantially equal at all turns positions.

14. The coil of claim 12, further comprising a ground plane electrically connected to at least one point along the length of the coil conductor.

15. The coil of claim 14, wherein the ground plane is connected substantially to the midpoint of the coil conductor.

16. The coil of claim 1, wherein the conductor has a round cross-sectional.

17. The coil of claim 16, wherein the conductor is hollow.

18. A lamp, comprising:

an HID tube having an exterior surface; and an excitation coil positioned adjacent to said tube exterior surface for producing a discharge arc plasma in the tube, said coil having at least one turn of a conductor arranged generally upon an exterior surface of a torus having a substantially V-shaped cross-section.

19. The lamp of claim 18, wherein the slanted surfaces of the cross-section of the torus appear to merge at a point within the envelope of the HID tube.

20. The lamp of claim 19, wherein the merge point appears to be substantially at the center of the discharge arc plasma.

* * * * *